US012252830B2

(12) United States Patent
Johansson et al.

(10) Patent No.: US 12,252,830 B2
(45) Date of Patent: Mar. 18, 2025

(54) LAUNDRY PROCESSING MACHINE, AND METHOD OF STARTING A LAUNDRY PROCESSING MACHINE

(71) Applicant: ELECTROLUX PROFESSIONAL AB (PUBL), Stockholm (SE)

(72) Inventors: Silvana Johansson, Ljungby (SE); Neal Milch, Woodmere, NY (US); Marius Stücheli, Ljungby (SE)

(73) Assignee: ELECTROLUX PROFESSIONAL AB (PUBL), Stockholm (SE)

( * ) Notice: Subject to any disclaimer, the term of this patent is extended or adjusted under 35 U.S.C. 154(b) by 547 days.

(21) Appl. No.: 17/602,900

(22) PCT Filed: Apr. 16, 2020

(86) PCT No.: PCT/SE2020/050393
§ 371 (c)(1),
(2) Date: Oct. 11, 2021

(87) PCT Pub. No.: WO2020/214082
PCT Pub. Date: Oct. 22, 2020

(65) Prior Publication Data

US 2022/0195649 A1 Jun. 23, 2022

(30) Foreign Application Priority Data

Apr. 16, 2019 (SE) ..... 1900064-5

(51) Int. Cl.
*D06F 33/32* (2020.01)
*D06F 34/18* (2020.01)
(Continued)

(52) U.S. Cl.
CPC ..... *D06F 33/32* (2020.02); *D06F 34/18* (2020.02); *D06F 34/28* (2020.02);
(Continued)

(58) Field of Classification Search
None
See application file for complete search history.

(56) References Cited

U.S. PATENT DOCUMENTS

2012/0019114 A1* 1/2012 Hong ..... D06F 39/02 312/228.1
2013/0042416 A1 2/2013 Balinski et al.
(Continued)

FOREIGN PATENT DOCUMENTS

CN 106350958 A 1/2017
JP 2004-121479 A 4/2004
JP 2007-175370 A 7/2007

OTHER PUBLICATIONS

Japan Patent Office, Office Action (Notice of Reasons for Rejection) issued in corresponding Application No. 2021-560098, mailed Jan. 9, 2024.

(Continued)

*Primary Examiner* — Cristi J Tate-Sims
(74) *Attorney, Agent, or Firm* — Stites & Harbison, PLLC; David W. Nagle, Jr.

(57) ABSTRACT

A laundry processing machine comprises: a rotatable drum; a load sensing arrangement configured to detect an amount of laundry in the drum and, based on a detected amount of laundry, generate a load signal; and a controller configured to initiate a laundry processing program, wherein the controller is configured to receive a capacity mode signal indicating a temporary maximum load, and, based on the load signal indicating a load equal to or lower than the temporary maximum load, allowing the laundry processing program to start.

13 Claims, 6 Drawing Sheets

(51) Int. Cl.

| | |
|---|---|
| ***D06F 34/28*** | (2020.01) |
| *D06F 103/04* | (2020.01) |
| *D06F 105/50* | (2020.01) |
| *D06F 105/60* | (2020.01) |

(52) U.S. Cl.
CPC ..... *D06F 2103/04* (2020.02); *D06F 2105/50* (2020.02); *D06F 2105/60* (2020.02)

(56) References Cited

U.S. PATENT DOCUMENTS

| | | | | |
|---|---|---|---|---|
| 2013/0086754 | A1* | 4/2013 | Hendrickson ..... | D06F 34/18<br>68/12.04 |
| 2014/0085046 | A1 | 3/2014 | Shin et al. | |
| 2015/0152584 | A1* | 6/2015 | Gasparini ..... | D06F 33/37<br>68/12.04 |
| 2018/0002858 | A1* | 1/2018 | Hombroek ..... | D06F 33/37 |

OTHER PUBLICATIONS

European Patent Office, Extended European Search Report issued in corresponding Application No. EP 20791258.5 dated Dec. 8, 2022.

* cited by examiner

Fig. 12
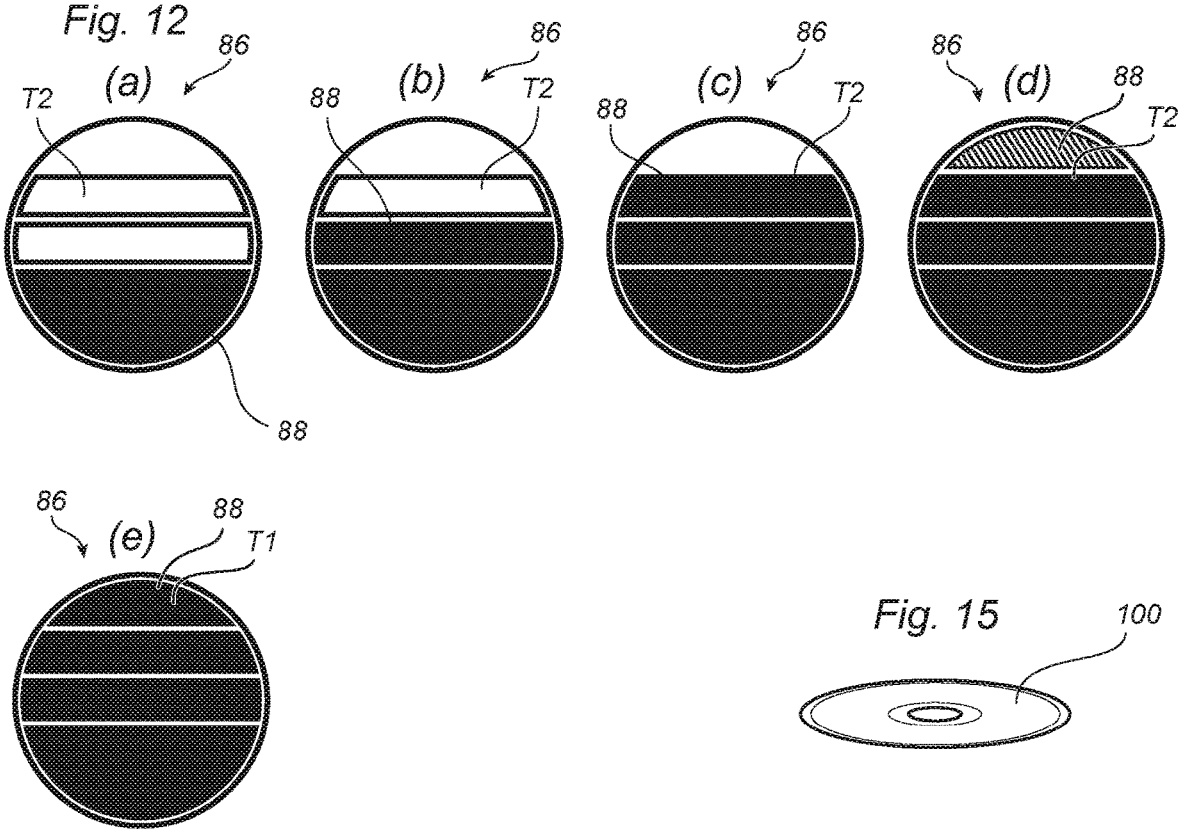
Fig. 15
Fig. 13
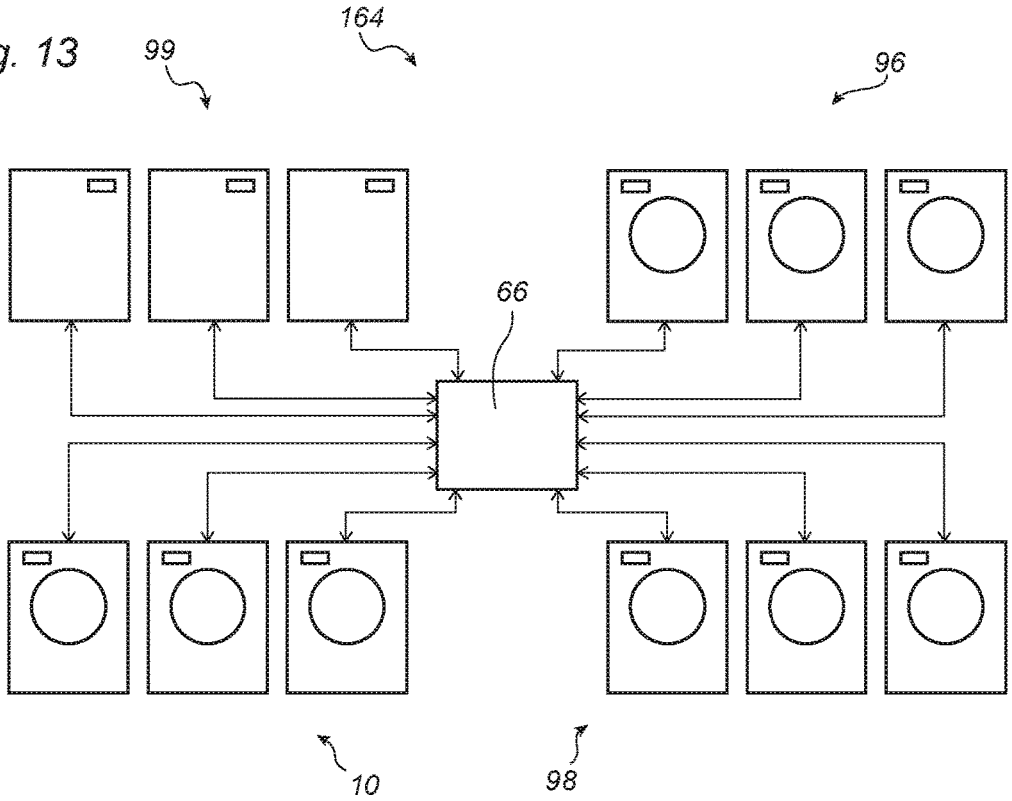

LAUNDRY PROCESSING MACHINE, AND METHOD OF STARTING A LAUNDRY PROCESSING MACHINE

FIELD OF THE INVENTION

The present invention relates to laundry processing machines, to a laundry facility comprising laundry processing machines, and to methods of starting a laundry processing machine.

BACKGROUND

Laundry processing machines, such as laundry washing machines, laundry dryers, combined washer dryers, centrifuges, etc, are ubiquitous. They generally comprise a rotatable drum for receiving laundry to be processed, wherein the drum rotates the laundry during processing, for example in order to impart mechanical action to the laundry, remove washing liquid from the laundry, or maximize the laundry's exposure to e.g. washing liquid and/or hot air, as the case may be. Some laundry processing machines are deployed as stand-alone laundry washing machines in domestic environments, while other laundry processing machines may be deployed in commercial laundry facilities comprising several machines, which may be shared between multiple households or accessible to the public. Still other laundry processing machines may be owned and serviced by a machine provider, and deployed at the premises of a client, who leases the machines for use on their premises (OPL, "on the premises laundry"). Shared or public laundry facilities may operate a booking system for ascertaining that machines are available when a user arrives at the laundry facility; alternatively, they may operate on a first-come, first-served basis, according to which a user may have to wait for a particular machine to become available. In household or OPL laundry processing machines as well as in public or shared laundry facilities, there are various parameters affecting the laundry processing result, and there is sometimes a need for guiding or assisting the user to operate the laundry processing machine in the way intended by the manufacturer.

Moreover, any reduction in consumption of water, energy, and detergent reduces a laundry machine's impact on the environment. The risk of operating a laundry processing machine in a manner different from that intended by the manufacturer, resulting in a suboptimal laundry result, is particularly high in public or shared laundry processing facilities, and in OPL installations. US2003/0154557 A1, disclosing a laundry washing machine for public laundry facilities, partly addresses this issue. However, there is still room for improving the laundry process.

SUMMARY

It is an object of the present invention to solve, or at least mitigate, parts or all of the above mentioned problems. To this end, according to a first aspect, there is provided a laundry processing machine comprising a rotatable drum; a load sensing arrangement configured to detect an amount of laundry in the drum and, based on a detected amount of laundry, generate a load signal; and a controller configured to initiate a laundry processing program, wherein the controller is configured to: receive a capacity mode signal indicating a temporary maximum load; and, based on the load signal indicating a detected load equal to or lower than the temporary maximum load, allowing the laundry processing program to start. Thereby, the laundry processing machine may be temporarily reconfigured to a temporary maximum load other than its physical maximum load limit, which allows adapting the laundry processing machines to different use scenarios and changing situations. By way of example, the possibility to set a temporary maximum load facilitates the allocation of laundry processing machines within a laundry facility, and/or the distribution of laundry to be processed between a plurality of machines within a facility such that machine utilization and consequent wear and tear is equalized. Moreover, it may facilitate loading of laundry into the laundry processing machine by untrained or inexperienced users within parameters set by the manufacturer or owner such that sub-optimal laundry processing results may avoided. Still further, the temporary maximum load may be set based on e.g. an amount of available resources, such as a temporary water shortage or limited supply of detergent. The capacity mode signal may be received from a user interface for operating an individual laundry processing machine. Alternatively, the capacity mode signal may be received from a laundry facility control system controlling multiple laundry processing machines, for example in order to increase a number of available laundry processing machines of a certain capacity, i.e. having a certain load limit. Herein, the term "load" should be construed as a force exerted by the laundry on the laundry processing machine, either due to its weight, or due to its inertia. Hence, a detection, by the load sensing arrangement, of the amount of laundry would typically correspond to a detection of the weight of the laundry. Typically, the drum may be configured to rotate about a horizontal drum rotation axis, though other drum rotation axis orientations, such as a vertical drum rotation axis, are also possible.

According to an embodiment, the capacity mode signal may be based on any of a user identity, a user category, a selected laundry processing program, a time of the day, a day of the week, and a day of the month. Thereby, the machine utilization may be better adapted to changing conditions as well as to particular needs.

According to an embodiment, the controller may be configured to, if the load signal indicates a load higher than the temporary maximum load, provide an overweight signal to a user of the machine via a user interface. Optionally, the controller may calculate an amount of overweight, and indicate the amount of overweight to the user or direct the user to remove laundry from the drum via e.g. visual or audible signals.

According to an embodiment, the temporary maximum load may be adjusted or cleared based on a user identity or user category of the user. For example, certain skilled users may be cleared for a higher maximum load, while still others, such as service personnel, may be free from any load limit constraints.

According to an embodiment, the controller is further configured to set a resource threshold for starting the laundry processing program, the resource threshold being associated with said temporary maximum load; receive a resource signal indicating an amount of resources provided by a user of the laundry processing machine; and, based on the resource signal indicating that a sufficient amount of resources has been provided, allowing the laundry processing program to start.

According to a second aspect, parts or all of the above mentioned problems are solved, or at least mitigated, by a laundry processing machine comprising a rotatable drum; a load sensing arrangement configured to detect an amount of laundry in the drum and, based on a detected amount of laundry, generate a load signal; and a controller configured to: based on the load signal, set a resource threshold for starting a laundry processing program; receive a resource signal indicating an amount of resources provided by a user of the laundry processing machine; and, based on the resource signal indicating that a sufficient amount of resources has been provided, allowing the laundry processing program to start. Thereby, the starting of a laundry process which is not adapted to the amount of available resources may be avoided, which warrants a good laundry result.

According to an embodiment of any of the above aspects, the resource threshold may comprise a fixed portion, which is independent of the load signal, plus a variable portion, which is dependent on the load signal. Such an arrangement results in a more efficient resource provisioning. According to an embodiment, the variable portion may be proportional to the weight of the laundry, for example in a continuous or step-wise manner. Alternatively, the resource threshold may be based on the load signal following any other function, which may be linear or non-linear.

According to an embodiment, the resource threshold may comprise only the variable portion, i.e. without any fixed portion.

According to an embodiment of any of the above aspects, the resource threshold is a linear function of the load signal starting from zero, a linear function starting from an offset, a piecewise linear but continuous function, a piecewise linear function with steps or any non-linear function. It is beneficial to be able to use different functions for the resource threshold to adapt the laundry processing machine for different purposes and needs.

According to an embodiment, the controller may be configured to display the resource threshold via a user interface. The user interface may be provided on the laundry processing machine, or on a separate unit such as a smart phone or a user interface shared by several laundry processing machines of a laundry facility. The resource threshold may be displayed in fixed increments. The fixed increments may be representative of a percentage of a physical maximum load limit of the laundry processing machine. The percentage may be presented alphanumerically, for example as 50%, 75%, 100%, or graphically, for example by a bar on a display, or by lighting up a respective subset of a plurality of light emitting diodes.

According to an embodiment, the controller may be configured to repeatedly, while the laundry processing machine is loaded via an open door, receive a load signal; update the resource threshold based on the load signal; and display the updated resource threshold on the user interface. Thereby, the user of the laundry processing machine may adapt the amount of laundry to the amount of resources available.

According to an embodiment, said amount of resources provided by a user comprises an amount of chemical process aid such as detergent, softener, bleaching agent etc provided to the laundry processing machine by the user, an amount of tokens or credits provided to a control system controlling the laundry processing machine, or an amount of money provided to a payment system operably connected to the laundry processing machine. According to examples, detergent may be provided to the laundry processing machine either by manually dispensing detergent into a detergent input of the laundry processing machine, or by manually activating an automatic dispensing operation providing detergent from a detergent storage to a washing chamber of the laundry processing machine. Tokens may be provided by, for example, inserting a number of physical tokens into a token slot arranged on the laundry processing machine or on a control panel operably connected to the laundry processing machine, or by withdrawing a number of virtual tokens from a user account associated with a user identity. The user identity may be verified using e.g. a smart card, passcode, biometric identification, etc. Money may be inserted into a cash payment interface arranged on the laundry processing machine or on a control panel operably connected to the laundry processing machine, by presenting a credit card to such an interface or control panel. or by effecting a payment from a smartphone or other independent electronic device. A supply of the wrong amount of resources, such as detergent, may result in a laundry process which is less efficient. The payment of the wrong number of tokens or amount of money may result in the wrong laundry processing program being run, or the desired program being run but with water, detergent and energy automatically calculated for the wrong amount of laundry.

According to an embodiment, the resource threshold may be set based on any of a user identity, a user category, a selected laundry processing program, a time of the day, a day of the week, and a day of the month. Thereby, the machine utilization may be better adapted to changing conditions as well as to particular needs.

According to an embodiment, the load sensing arrangement may be configured to detect the amount of laundry by detecting a static load on the drum. Thereby, the load sensing arrangement may detect the amount of laundry during loading of laundry into the drum, such that the user may adapt the amount of laundry to an amount of available resources or vice versa. The static load may be sensed while the drum is stationary, i.e. when it is not rotated by the laundry processing machine's controller. Alternatively, the controller may be configured to rotate the drum, and detect the amount of laundry by measuring a dynamic load during rotation. The dynamic load may be determined based on signals from one or several load sensors measuring a vertical load exerted by the drum during rotation, or based on the dynamic torque generated by a drum rotation motor. Whether detecting static load, dynamic load, or both, the load sensing arrangement may be configured to repeatedly or continuously detect the load, for example during a detection time which may be pre-set or determined based on the user's interaction with the laundry processing machine. Several load measurements may be averaged, and different individual measurements and/or averages may be weighted differently, based on their values and/or based on the conditions during which they were sampled, for determining a detected load of greater accuracy.

According to an embodiment, the load sensing arrangement may comprise a plurality of spatially separated load sensors, each load sensor configured to generate a respective load signal component, wherein the controller is further configured to allow the laundry processing program to start based on a relationship between the load signal components. The relationship between the load signal components may be representative of a static load distribution within the drum. If the static load distribution indicates a static imbalance exceeding an imbalance threshold, this may indicate that the drum has been tampered with, and the laundry processing program should not be allowed to start. A static imbalance may be determined, for example, by determining that a detected centre of mass of the laundry is located at an axial position along the drum rotation axis direction which is offset from the centre of the drum by an offset distance exceeding a threshold offset distance, or even located outside the drum.

According to an embodiment, the controller is configured to determine the load signal components corresponding to a torque about a horizontal axis extending through the centre of the rotatable drum perpendicular to the drum axis A of rotation and, if the determined torque is below a predetermined level or a threshold determined based on the detected weight, start the laundry processing program. This embodiment makes it possible to identify possible tamper by the user since any efforts to lift the outer end of the drum to reduce the determined weight of the laundry in the drum is likely to be identified by the spatially separated load sensors so the torque can be calculated and compared to the predetermined level or a calculated threshold.

According to an embodiment, the load sensing arrangement may be configured to detect a static load prior to rotating the drum, and the controller may be configured to compare the static load with a dynamic load while rotating the drum, and based on the comparison, determine whether the drum has been tampered with. The relationship between the static and dynamic load may indicate whether the drum has been tampered with, which may serve as a basis for determining whether the laundry processing program should be allowed to start.

According to an embodiment, the controller may be configured to determine whether to allow the laundry processing program to start based on a detection of the amount of laundry in the drum after closing a drum access door, such as an outer housing door and/or a water-tight washing chamber door. Such an arrangement renders any tampering with the load sensing arrangement more difficult. The load detection after closing the drum access door may be compared to a load detection prior to closing the drum access door and, if the amount of laundry differs by more than a threshold amount, an error signal may be generated. A discrepancy, e.g. defined as a ratio or percentage, between the weight obtained prior to and after closing the drum access door may be indicative of the load sensing having been tampered with while the drum access door was open.

According to an embodiment, the laundry processing machine may further comprise a drum assembly suspension frame provided with an outer laundry processing machine housing, and a drum assembly comprising the drum and a water-tight washing chamber enclosing the drum, the drum assembly being flexibly suspended in the drum assembly suspension frame, wherein the outer laundry processing machine housing further comprises an outer housing opening for loading laundry into the drum, and an outer housing door for blocking access to the drum assembly via the outer housing opening, wherein the load sensing arrangement is arranged at an interface between the drum assembly and the drum assembly suspension frame to detect a load exerted by the drum assembly on the drum assembly suspension frame, and the controller is configured to determine whether to allow starting the laundry processing program based on a load detected after closing of the outer housing door. The outer housing door thereby prevents tampering with the drum assembly during static or dynamic load detection. A load detection after closing the outer housing door may be part of a final check for determining whether enough resources have been provided by the user.

According to an embodiment, the laundry processing machine may comprise a drum assembly comprising the drum and a water-tight washing chamber enclosing the drum, the washing chamber comprising a washing chamber door, wherein the drum is rotatably suspended in the washing chamber via a drum suspension interface comprising a drum bearing, wherein the load sensing arrangement is arranged at the drum suspension interface for detecting a load exerted by the drum on the washing chamber, and the controller is configured to allow starting the laundry processing program based on a load detected after closing the washing chamber door. After closing the washing chamber door, the drum will be fully enclosed by the washing chamber. The washing chamber door thereby prevents tampering with the drum during static or dynamic load detection. A load detection after closing the washing chamber door may be part of a final check for determining whether enough resources have been provided by the user.

According to an embodiment, the load sensing arrangement may be configured to determine a horizontal component of the load on the drum assembly or the drum. By determining a horizontal component of the load, i.e. a load directed along a horizontal plane, it may be possible to determine whether the drum assembly or the drum has been tampered with, which may serve as a basis for determining whether the laundry processing program should be allowed to start. For example, it may be possible to determine whether an object has been wedged into any space between the drum assembly and the housing wall or any drum suspension frame holding the drum assembly.

According to an embodiment, the laundry processing machine is one of a laundry washing machine, a laundry dryer, and a combined washer dryer. The laundry processing program may, for the respective alternative machine types, be a laundry washing program, a laundry drying program, and a combined laundry washing and drying program, respectively.

According to a third aspect, parts or all of the above mentioned problems are solved, or at least mitigated, by a laundry facility comprising a plurality of laundry processing machines, and a laundry facility controller configured to: maintain updated information indicating the availability of laundry processing machines for each of a plurality of different maximum loads; determine that a number of available processing machines of a certain maximum load, of said plurality of different maximum loads, falls below a threshold number; and, based on said determination, generate a capacity mode signal to a target laundry processing machine having a maximum load other than said certain maximum load, the capacity mode signal setting a temporary maximum load of said target laundry processing machine to said certain maximum load. Thereby, the maximum load of a laundry processing machine which is presently unavailable may be cloned to a laundry processing machine having a different maximum load. The plurality of laundry processing machines may comprise a plurality of laundry washing machines, a plurality of laundry dryers, a plurality of combined washer dryers, or a combination thereof. According to an embodiment, each of the laundry processing machines of said plurality of laundry processing machines has the same physical maximum load limit. Thereby, service and spare parts management of the machine park may be simplified. Said plurality of different maximum loads may, in such a configuration, be obtained by setting different temporary maximum loads of otherwise, from a physical maximum load limit perspective, equivalent laundry processing machines. The laundry processing machines may even be of the same model.

According to an embodiment, the target laundry processing machine may be selected among the laundry processing machines having a maximum load different from said certain maximum load. However, according to another example, all available laundry processing machines may regularly receive capacity mode signals generating a preferred distribution of the available laundry processing machines between the plurality of different temporary maximum loads, without any prior information on the availability of each respective maximum load of said different maximum loads when generating the capacity mode signals.

According to an embodiment, the controller may be configured to indicate the temporary maximum load associated with each respective laundry processing machine on a user interface. The user interface may be common to all laundry processing machines. Alternatively, each laundry processing machine may have a respective user interface displaying its respective temporary maximum load.

According to a fourth aspect, parts or all of the above mentioned problems are solved, or at least mitigated, by a method of starting a laundry processing machine, the method comprising the steps: receiving a capacity mode signal indicating a temporary maximum load; receiving laundry into a drum of the laundry processing machine; weighing the laundry in the drum; and, based on the weight of the laundry in the drum corresponding to a detected load equal to or less than the temporary maximum load, allowing a laundry processing program to start. The steps may be performed in the order listed above. However, except where a certain step is implicitly required for generating input to a subsequent step, the steps may be performed in any other order.

According to an embodiment, the method may comprise receiving an amount of resources for operating the laundry processing machine, wherein the laundry processing program is allowed to start based also on the received amount of resources. The amount of resources may be compared to a resource threshold, which may be set based on the temporary maximum load.

According to an embodiment, the capacity mode signal may be generated based on the selection of a laundry processing program from a plurality of laundry processing programs.

According to a fifth aspect, parts or all of the above mentioned problems are solved, or at least mitigated, by a method of starting a laundry processing machine, the method comprising the steps: receiving laundry into a drum of the laundry processing machine; weighing the laundry in the drum; determining a resource threshold based on the weight of the laundry in the drum; receiving resources for operating the laundry processing machine; comparing the resource threshold with the amount of received resources; and, based on said comparison, determining whether a laundry processing program is to be allowed to start. Again, the steps may be performed in the order listed above. However, except where a certain step is implicitly required for generating input to a subsequent step, the steps may be performed in any other order.

According to an embodiment, the method further comprises determining that a washing chamber door is closed, wherein weighing the laundry in the drum comprises weighing the laundry in the drum when the washing chamber door is closed; and wherein determining a resource threshold based on the weight of the laundry in the drum comprises determining a resource threshold based on the weight of the laundry in the drum determined when the washing chamber door is closed.

According to an embodiment, weighing the laundry in the drum when the washing chamber door is closed comprises obtaining, during a detection time interval, multiple samples of the weight of the laundry in the drum. Thereby, any variation of the detected weight over time may be detected, which may indicate that the drum has been exposed to tampering or other outside forces during sampling. As any tampering is likely to generate a detected load which varies over a sampling time of a few seconds, the detection interval may, according to embodiments, exceed 1 second, 5 seconds, or 10 seconds. The detection interval may typically be shorter than about 30 seconds, to avoid undue delays for the user. The method may comprise determining if the multiple samples differ from each other by more than a threshold, and if so, prevent starting of the laundry processing machine. Alternatively or additionally, the multiple samples may be given different significance or relative weighting for determining the resource threshold. By way of example, relatively higher weight values of said multiple samples may be given a higher weighting for determining the resource threshold, whereas relatively lower weight values of said multiple samples may be given a lower weighting for determining the resource threshold.

According to an embodiment of the method, the time interval is divided into multiple sub intervals, whereby the sub intervals with a change of the detected weight over time greater than either a predetermined value or a threshold determined based on the detected weight, are disregarded in the determination of the weight of the laundry in the drum. This embodiment is intended to identify possible unintended interference or tamper by the user since variations in the detected weight over time is detected.

According to an embodiment of the method, the controller is configured to allow the laundry processing program to start if the variation of the samples of the weight of the laundry in the drum is below either a fixed predetermined value or a threshold determined based on the detected weight. This embodiment is intended to identify possible tamper by the user since variations in the detected weight indicate that the drum has been manipulated which will make it impossible to start the laundry process. The variations could for example be measured as the standard deviation of a set of samples, the difference of the maximum value and the minimum value within a set of samples, or the ratio of the load signal difference to the time difference between any two of the samples.

According to an embodiment of the method, the time interval is divided into multiple sub intervals, whereby the highest among the load signals obtained per sub interval is used to determine the weight of the laundry in the drum. This embodiment is intended to automatically consider the sub interval with the lowest level of manipulation, if the drum is manipulated with a variable amount of load lifted off the load sensing arrangement during the time interval when the load signal is sampled.According to an embodiment, the method may further comprise receiving a selection of a laundry processing program, wherein the resource threshold is determined also based on the selected laundry processing program. According to an embodiment, determining a resource threshold based on the weight of the laundry in the drum comprises, for each of a plurality of laundry processing programs, determining a respective resource threshold based on the weight of the laundry in the drum; the method further comprises receiving a selection of a laundry processing program from said plurality of laundry processing programs; comparing the resource threshold with the amount of received resources comprises comparing the resource threshold of the selected laundry processing program with the received amount of resources; and determining, based on said comparison, whether the laundry processing machine is to be allowed to start comprises determining, based on said comparison, whether the selected laundry processing program is to be allowed to start.

According to an embodiment of the method, the selection of a laundry processing program is based on a user interaction, and the detection time interval for detecting the weight starts before, or during, the user interaction and ends during or after the user interaction to select the desired laundry process. The user interaction is for example a selection of a particular washing program, a selection of a part ("option") of a washing program, or a confirmation of an earlier conducted pre-selection of a washing program or a part of a washing program.

According to an embodiment, each respective resource threshold may be communicated to the user of the machine via a user interface. This facilitates selecting a program for which enough resources are available.

According to a sixth aspect, there is provided a computer program comprising instructions which, when the program is executed by a computer, cause the computer to carry out any of the methods defined above.

According to a seventh aspect, there is provided a computer readable data carrier comprising the computer program defined above.

It is noted that embodiments of the invention may be embodied by all possible combinations of features recited in the claims. Further, it will be appreciated that the various embodiments described for the laundry processing machines defined in accordance with the first and second aspects above are all combinable with the laundry facility as well as with the methods as defined in accordance with the third, fourth and fifth aspects of the present invention, and vice versa.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein:

FIGS. 12(*a*)-(*d*) are schematic illustrations of the resource indicator of FIG. 10, wherein the resource indicator in each figure illustrates a different respective detected laundry load of the laundry washing machine of FIGS. 1-3 in relation to the temporary maximum load illustrated in FIG. 11(*c*);

FIG. 12(*e*) is a schematic illustration of the resource indicator of FIG. 10, wherein the resource indicator illustrates a detected laundry load of the laundry washing machine of FIGS. 1-3 in relation to the temporary maximum load illustrated in FIG. 11(*d*);

FIG. 13 is a block diagram illustrating a laundry facility according to a second embodiment, the laundry facility comprising a plurality of laundry dryers, a plurality of laundry washer dryers, a plurality of laundry centrifuges, and a plurality of laundry washing machines of the type illustrated in FIGS. 1-3;

FIG. 15 is a view in perspective of a Compact Disc.

All the figures are schematic, not necessarily to scale, and generally only show parts which are necessary in order to elucidate the embodiments, wherein other parts may be omitted.

DETAILED DESCRIPTION OF THE EXEMPLARY EMBODIMENTS

Figure 1:
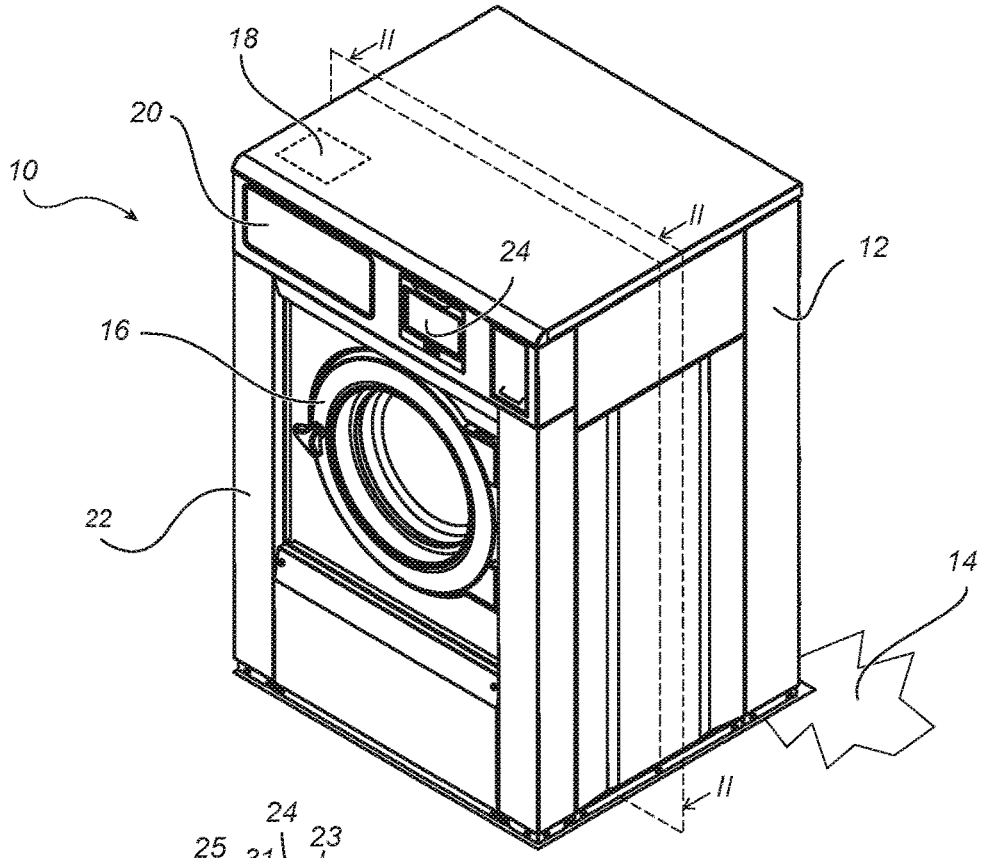
FIG. 1 is a diagrammatic view in perspective of a laundry washing machine.

FIG. 1 illustrates a laundry washing machine 10. The laundry washing machine comprises a rotatable drum (FIG. 2) in a water-tight washing chamber (FIG. 2) arranged in an outer housing 12. The washing machine 10 is positioned on a fixed base structure 14, such as a floor. A washing chamber door 16 provides access to the interior of the drum, for loading and unloading laundry. The laundry washing machine 10 further comprises a controller 18 configured to operate various laundry washing programs. A user interface 20, arranged on a front housing wall 22 of the laundry washing machine 10, allows a user of the laundry washing machine 10 to select among, and start, the various laundry washing programs. The front housing wall 22 also comprises a tray 24 for allowing the user to insert detergent into the laundry washing machine 10.

Figure 2:
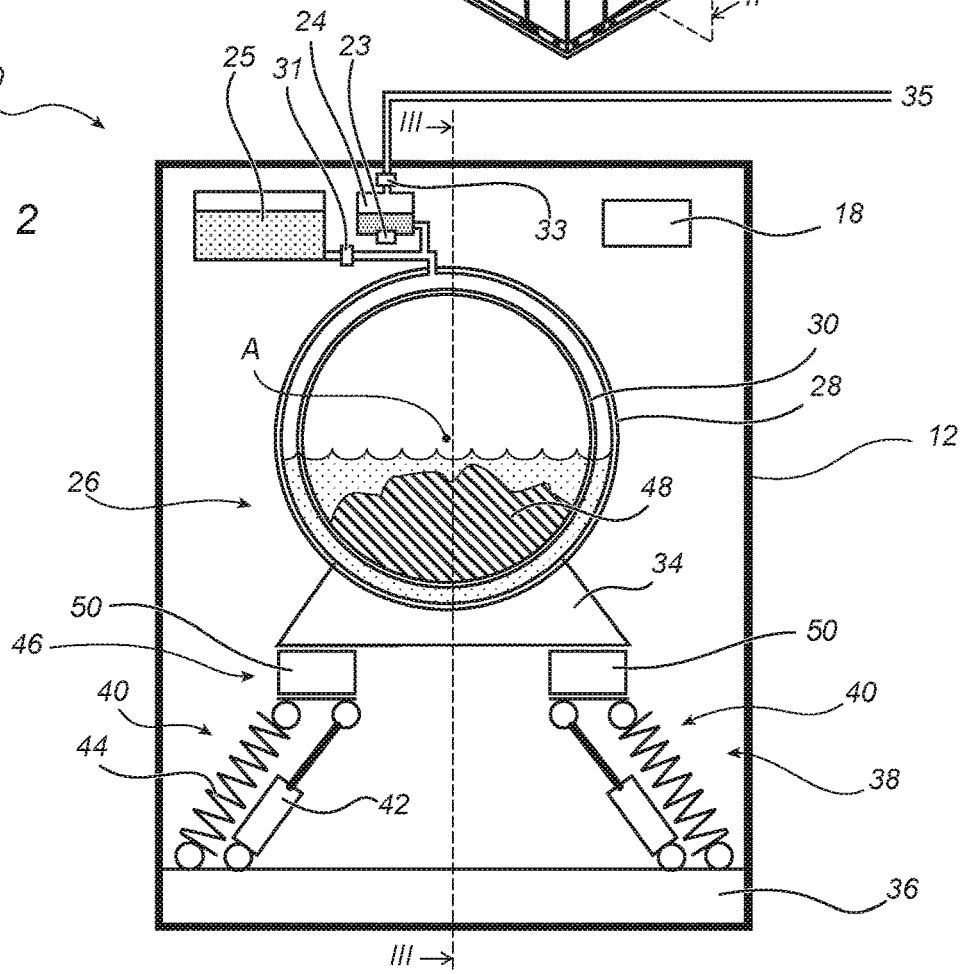
FIG. 2 is a schematic view in section, taken along the plane II-II-II illustrated in FIG. 1, of the laundry washing machine of FIG. 1.

FIG. 2 schematically illustrates a cross-section of the laundry washing machine 10 taken along the plane II-II illustrated in FIG. 1. The laundry washing machine 10 comprises a drum assembly 26 comprising the washing chamber 28, which has a substantially circular-cylindrical shape, and the drum 30, which is also circular-cylindrical with its axis of rotation symmetry A coinciding with the axis of rotational symmetry A of the washing chamber 28. The drum 30 is rotatably suspended in the washing chamber 28 via a drum suspension interface comprising a drum bearing 32 (FIG. 3), which allows rotating the drum 30 about its symmetry axis A within the washing chamber 28. The drum assembly 26 further comprises a cradle 34, which is rigidly connected to, and carries, the washing chamber 28. The drum assembly 26 is suspended on a drum assembly suspension frame 36 via a flexible suspension arrangement 38, which allows the drum assembly 26 to vibrate relative to the drum assembly suspension frame 36. In the illustrated embodiment, the suspension arrangement 38 comprises, in each of four corners of the cradle 34, a respective flexible suspension 40, each flexible suspension 40 comprising a damper 42 and a resilient element 44 such as a spring. The drum assembly suspension frame 36 also rigidly holds the outer housing 12, and firmly rests on the fixed base structure 14 (FIG. 1).

The laundry washing machine 10 further comprises a load sensing arrangement 46 configured to detect the amount of laundry 48 in the drum 30. Based on the detected amount of laundry, the load sensing arrangement 46 generates a load signal to the controller 18. The load sensing arrangement 46 comprises a plurality of drum assembly load sensors 50, each of which is arranged between the cradle 34 and a respective suspension 40 of said suspension arrangement 38. Each of the drum assembly load sensors 50 is configured to measure the vertical load exerted by the drum assembly 26 on the respective suspension 40, and based on the load, generate a respective load signal component of said load signal transmitted to the controller 18. The drum assembly load sensors 50 may, for example, be configured as load cells provided with strain gauges. In the illustrated embodiment, the weight of the laundry 48 is obtained by summing up the total vertical load detected by all respective drum assembly load sensors 50, and subtracting a calibration load detected when the drum 30 is empty, i.e. before inserting the laundry 48. FIG. 2 again illustrates the detergent tray 24, which is connected to the washing chamber 28. The detergent tray 24 is provided with a detergent detector 23 for detecting an amount of detergent therein. The detergent detector 23 may, for example, comprise a load cell. Moreover, an internal detergent storage container 25 is connected to the washing chamber 28 via an automatic detergent dispenser 31, such as a pump or magnetic valve for liquid detergent, or a screw conveyor for laundry washing powder, as the case may be. The detergent dispenser 31 is controlled by the controller 18 for automatic dosing of the amount of detergent from the internal detergent storage container 25, in case the user does not wish to use his/her own detergent. Similarly, the controller 18 also controls a water supply valve 33, which may be e.g. a magnetic valve, for dispensing water from a tap water supply 35, via the detergent tray 24, into the washing chamber 28.

Figure 3:
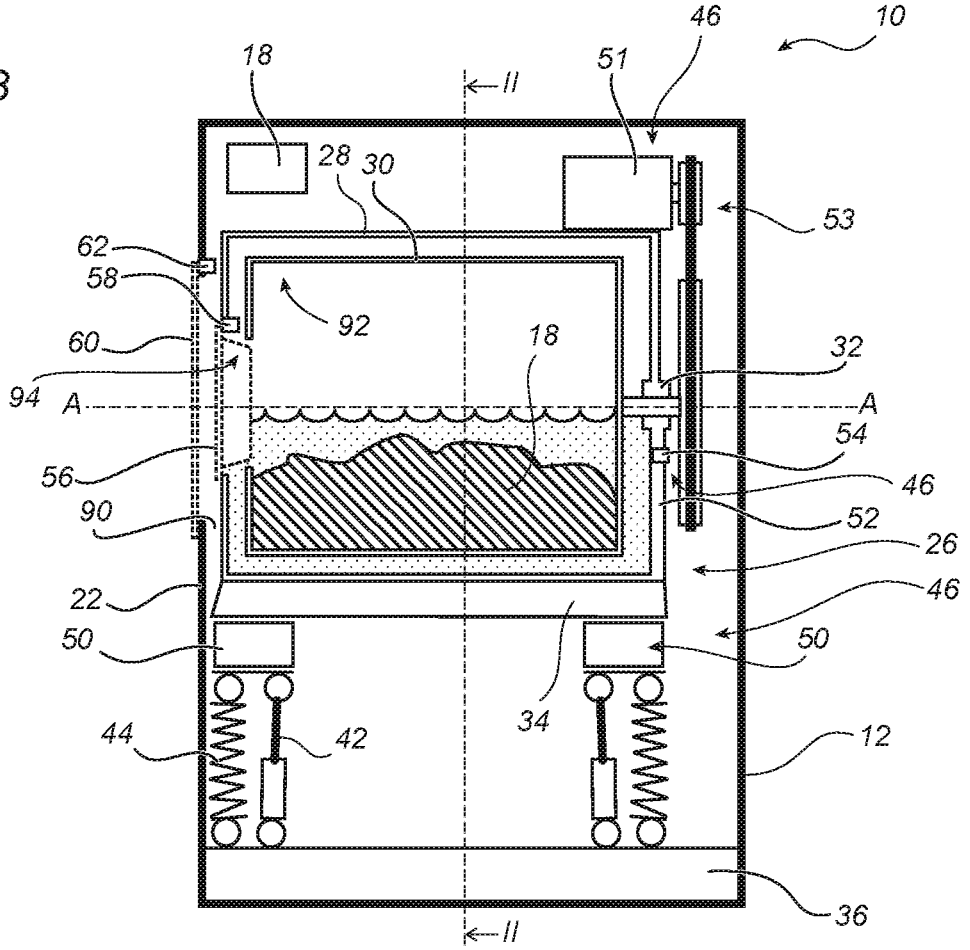
FIG. 3 is a schematic view in section, taken along the plane III-III illustrated in FIG. 2, of the laundry washing machine of FIGS. 1 and 2.

FIG. 3 illustrates the laundry washing machine 10 in a section along the line III-III of FIG. 2. The view illustrates how the drum 30 is rotatably suspended in the washing chamber 28 via the drum bearing 32, which is carried by a drum support structure 52 at the back wall of the washing chamber 28. An electric motor 51, operated by the controller 18, drives the drum 30 to rotate about the rotation axis A via a belt-and-pulley transmission 53. The load sensing arrangement 46 further comprises a drum load sensor 54 connected to the drum support structure 52. It is pointed out that the drum assembly load sensors 50 detect the amount of laundry in the drum 30 by weighing the entire drum assembly 26 together with the laundry 48, whereas the drum load sensor 54 detects the amount of laundry 48 in the drum 30 by weighing only the drum 30 together with the laundry 48. The drum assembly load sensors 50 and the drum load sensor 54 are two independent means of detecting the amount of laundry 48 in the drum 30. A third independent means of detecting the amount of laundry 48 in the drum 30 is provided by the controller 18 and the motor 51. The controller 18 is configured to record the electric current provided to the motor 51 and the rotary speed of the motor 51, wherein the electric current is representative of the torque required for accelerating the drum 30, and hence, also representative of the weight of the drum 30 together with the laundry 48. It is pointed out that the three means all have different benefits. They can all be used in parallel on a laundry washing machine 10, and the data received therefrom can be fused in the controller 18 to obtain a result of increased accuracy. Alternatively, a subset, or only one single, of the three means may be implemented on the laundry washing machine; still alternatively or additionally, the laundry washing machine may comprise any other means of determining the amount of laundry 48 in the laundry washing machine 10.

The drum assembly load sensors 50 and the drum load sensor 54 enable the load sensing arrangement 46 to detect the static load on the drum 30, without rotating the drum 30. Moreover, they can be used for measuring a dynamic load during rotation of the drum 30. The dynamic load may be determined e.g. based on signals from one or several of the load sensors 50, 54 measuring a load exerted by the drum 30 during rotation, or based on the dynamic torque generated by the motor 51.

The washing chamber 28 is provided with a washing chamber door 56, which cooperates with a washing chamber door sensor 58 indicating to the controller 18 whether the washing chamber door is closed or open. The outer housing 12 may also comprise an optional outer housing door 60 (not illustrated in the view of FIG. 1) which, in a similar manner, may cooperate with an outer housing door sensor 62 indicating to the controller 18 whether the outer housing door 60 is closed or open.

The laundry washing machine 10 has a physical maximum load limit L1, wherein L1 is the maximum weight of laundry 48 that the laundry washing machine is designed to process in each batch. The physical maximum load limit L1 may also referred to as the design capacity of the laundry washing machine 10. For an amount L1 of laundry, the controller 18 is configured to use an amount D1 of detergent and an amount of W1 of water from the tap water system which should be available for dispensing into the washing chamber 28.

Figure 4:
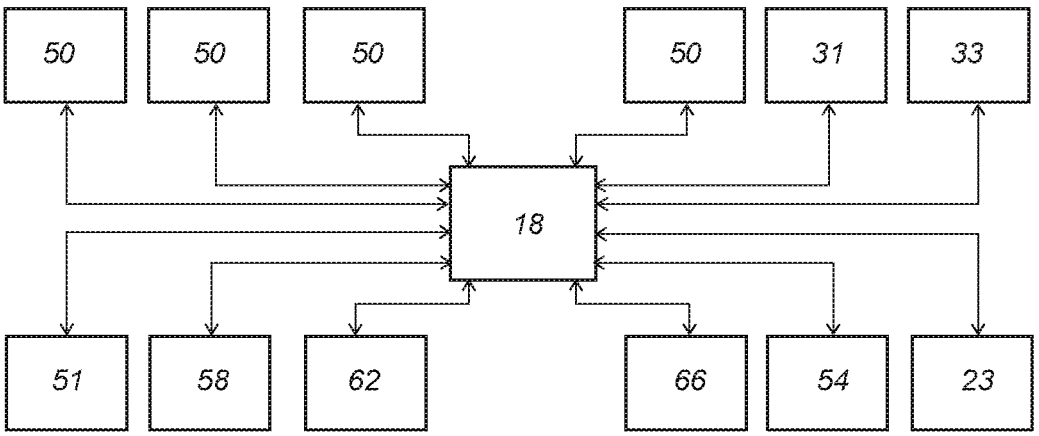
FIG. 4 is a block diagram illustrating the functional blocks of a control system of the laundry washing machine of FIGS. 1-3.

FIG. 4 schematically illustrates functional blocks of the control system of the laundry washing machine 10. The controller 18 is operatively connected to the drum assembly load sensors 50, the drum load sensor 54, the motor 51, the detergent dispenser 31, the water supply valve 33, the washing chamber door sensor 58, the outer housing door sensor 62, the detergent detector 23, and to a laundry facility controller 66 described in greater detail in the following.

Figure 5:
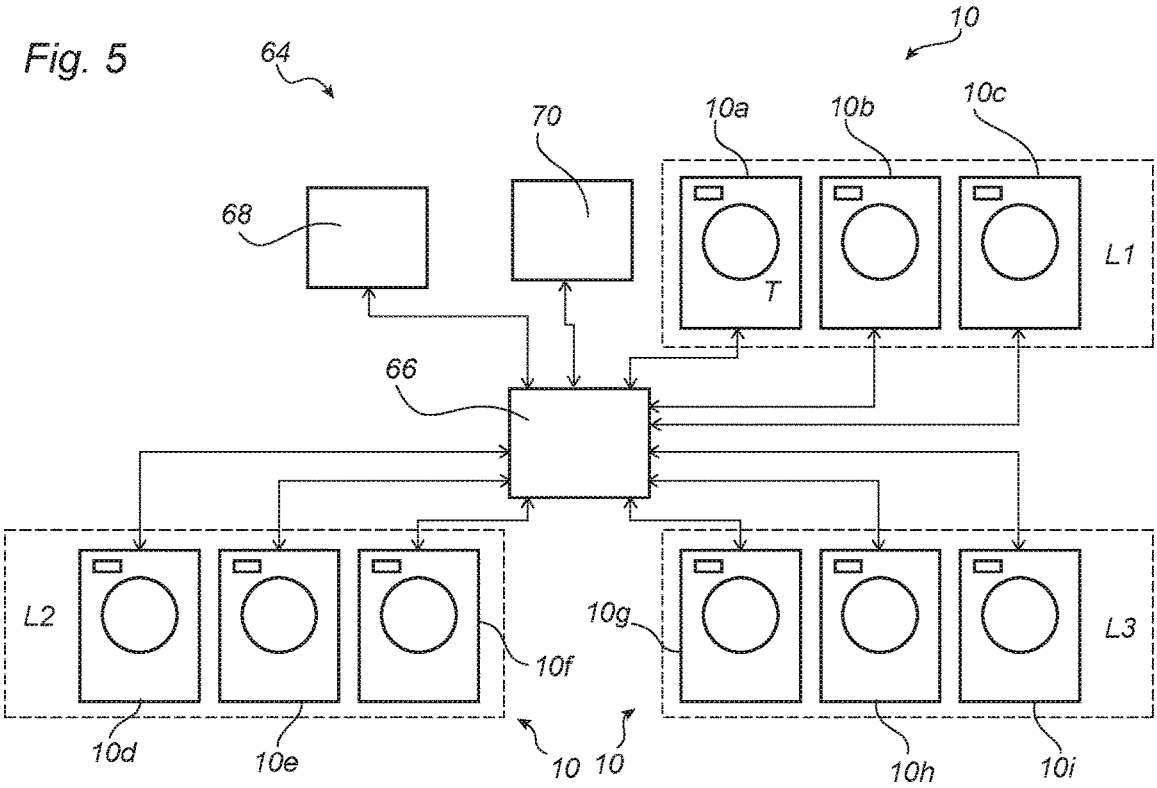
FIG. 5 is a block diagram illustrating a laundry facility, the laundry facility comprising a plurality of laundry washing machines of the type illustrated in FIGS. 1-3.

FIG. 5 illustrates a laundry facility 64, which may be a public self-service laundry facility ("laundromat"/"laundrette") or an on-the-premises laundry facility reserved e.g. for the residents of a residential area or the employees of a hospital. The laundry facility 64 comprises a first plurality of laundry washing machines 10*a*, 10*b*, 10*c* each having a physical maximum load limit L1, a second plurality of laundry washing machines 10*d*, 10*e*, 10*f* each having a physical maximum load limit L2, and a third plurality of laundry washing machines 10*g*, 10*h*, 10*i* each having and a physical maximum load limit L3, wherein L1>L2>L3. Typical physical maximum load limits generally range between 5 kg and 20 kg. By way of example, L1 may be 18 kg, L2 may be 12 kg, and L3 may be 8 kg. The laundry facility 64 comprises a laundry facility controller 66, which is operatively connected to each machine 10*a*-10*i*, and maintains updated information indicating the availability of laundry washing machines 10 for each of the different physical maximum load limits L1, L2, L3. The laundry facility controller 66 is also operatively connected to a laundry facility user interface 68, allowing the user to select an available laundry washing machine, and an authorization unit 70, which may comprise a payment interface such as a coin slot or credit card reader, or a user identification interface for verifying the identity of e.g.

an authorized user. Obviously, functionality may be distributed between the laundry facility controller 66 and the laundry washing machine controllers 18 (FIG. 1) in any suitable way; it is pointed out that the controller recited in the appended claims may be construed as the laundry washing machine controller 18, the laundry facility controller 66, the combined system made up by the laundry washing machine controller 18 and the laundry facility controller, or any other virtually or physically distributed controller, without departing from the scope of the claims.

The user interface 68 is configured to indicate to a user, for each load limit L1, L2, L3, which laundry washing machines 10*a*-10*i* are currently available, i.e. not already occupied by another user, and a respective cost R1, R2, R3 associated with running a laundry program for the respective load limits L1, L2, L3. Each laundry washing machine 10 may be capable of running several different respective laundry programs, each of which may be associated with a different cost. The user can thereby select, via the user interface 68, an available laundry washing machine 10 of a desired load limit L1, L2, L3, a laundry washing program, and whether to provide his/her own detergent via the detergent tray 24 or to allow the laundry washing machine to automatically dispense detergent from the internal detergent container 25. Based on the selection, the laundry facility controller 66 determines a cost and requests an authorization signal from the authorization unit 70, which in response provides an authorization signal to the laundry facility controller 66 once sufficient payment has been received from the user. Upon authorization, the laundry facility controller 66 enables the selected laundry washing machine 10 for use.

However, it may sometimes happen that a when a user, having an amount L3 of laundry to be washed, arrives at the laundry washing facility 64, all laundry washing machines 10*g*, 10*h*, 10*i* of physical maximum load limit L3 are busy. In prior art laundry facilities, the user would then have to choose between waiting until one of the laundry washing machines 10*g*, 10*h*, 10*i* becomes available, or having to pay a higher price R1 or R2 for one of the laundry washing machines 10*a*-10*f* of maximum load limit L1 or L2. The use of an unnecessarily large laundry washing machine may also increase consumption of other resources, such as water, energy, and/or detergent. A first operation scenario of the laundry facility 64 may however reduce the risk of such a situation occurring.

In said first operation scenario, the laundry facility controller is configured to determine when all laundry washing machines 10*g*-*i* of a certain physical maximum load limit L3 are occupied. If all laundry washing machines 10*g*-*i* of physical maximum load limit L3 are taken, and if there is more than one available laundry washing machine of a higher physical maximum load limit L1 or L2, the laundry facility controller 66 generates a capacity mode signal to a target laundry washing machine of said available laundry washing machines, to set a temporary load limit of the target laundry washing machine. By way of example, if laundry washing machines 10*a* and 10*b* are available, the laundry facility controller 66 may select laundry washing machine 10*a* as the target laundry washing machine, and generate a capacity mode signal setting a temporary maximum load T=L3 of the target laundry washing machine 10*a*. Once the temporary maximum load T has been set to L3, the laundry facility controller 66 will indicate the laundry washing machine 10*a*, of physical maximum load limit L1, as an available laundry washing machine of maximum load L3. When a new user arrives at the laundry facility, laundry washing machine 10*a* can be selected at cost R3. Alternatively, the temporary maximum load T may be selected by the user on arrival. In this way, only a single laundry washing machine of a capacity equal to or greater than that required by the user needs to be available.

Reference is again made to FIGS. 2-3, wherein the laundry washing machine 10 now represents the target laundry washing machine 10*a*. Once the user starts loading the laundry washing machine 10 via the drum access doors 56, 60, the controller continuously receives a load signal generated by the load sensing arrangement 46. If the amount of laundry 48 inserted into the drum 30 exceeds the temporary maximum load T=L3, the laundry washing machine 10 is prevented from starting, and the laundry washing machine user interface 20 may generate an overweight signal; else, once loading is completed, the laundry washing machine 10 is allowed to start. Upon starting, the laundry washing machine will dispense an amount W3 of water and an amount D3 of detergent associated with load L3 into the washing chamber 28. Alternatively, the laundry washing machine 10 may dispense an amount of water and detergent calculated based on the load detected by the load sensing arrangement 46.

Figure 6:
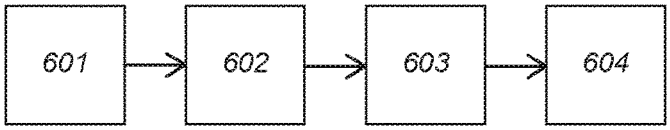
FIG. 6 is a flow chart illustrating a first operation scenario, the first operation scenario illustrating an exemplary operation of the laundry facility of FIG. 5.

The first scenario is schematically illustrated in the flow chart of FIG. 6:

In step 601, the controller 18 (FIG. 2) receives a capacity mode signal indicating a temporary maximum load T.

In step 602, the laundry washing machine 10 receives laundry 48 into the drum 30.

In step 603, the load sensing arrangement 46 weighs the laundry in the drum.

In step 604 the controller 18 decides, based on the weight of the laundry 48 in the drum 30 corresponding to a detected load equal to or less than the temporary maximum load T, whether to allow a laundry washing program to start.

Step 601 may alternatively be performed after step 602 or step 603.

The temporary maximum load T may be adjusted or cleared based on the authorization unit 70 identifying a user identity or a user category associated with a certain temporary maximum load, or associated with a "no-limit" load setting.

In a second operation scenario, and again referring to FIG. 5, all laundry washing machines 10*a*-10*i* are assumed to have the same physical maximum load limit L1, wherein L1>L2>L3. For each of the laundry washing machines 10*a*-10*i*, the laundry facility user interface 68 allows the user to select a target laundry washing machine 10*a*, as well as a temporary load limit T=L1, L2 or L3 to be associated with the selected target laundry washing machine 10*a*. Alternatively, the laundry facility user interface 68 may allow the user to select a temporary maximum load T=L1, L2 or L3, and the laundry facility controller 66 may automatically designate an available laundry washing machine 10*a*, to become the target laundry washing machine, to the user.

Based on the selected temporary maximum load T, the controller 66 generates a capacity mode signal to the target laundry washing machine 10*a* which, upon receipt, sets its temporary maximum load to T. The controller 66 may also set a resource threshold R, represented by an amount to be paid via the authorization unit 70, associated with the selected temporary maximum load T. Upon authorization from the authorization unit 70, ascertaining that the price corresponding to the respective cost R1, R2 or R3 associated with the selected temporary maximum load T has been paid, the laundry facility controller 66 enables the target laundry washing machine 10*a* for use. Upon enabling the activation of the selected laundry washing machine 10*a*, and again referring to FIG. 3, the user inserts laundry to be washed into the washing chamber 28, whereupon the load sensing arrangement 46 detects the amount of laundry 48 in the drum 30. After closing the washing chamber door 56, if the load detected by the load sensing arrangement 46 is less than or equal to the temporary maximum load T, the laundry washing machine 10 is allowed to be started; else, it is not.

In a third operation scenario, and starting by referring to FIG. 2, the user may not wish to use the detergent available from the internal detergent storage container 25. Instead, the user brings his/her own detergent to the laundry facility 64 (FIG. 5). Again referring to FIG. 5, all laundry washing machines 10*a*-10*i* are assumed to have the same physical maximum load limit L1, wherein L1>L2>L3. For each of the laundry washing machines 10*a*-10*i*, the laundry facility user interface 68 allows selecting a target laundry washing machine 10*a*, as well as a temporary load limit T=L1, L2, or L3, to be associated with the selected target laundry washing machine 10*a*. Based on the selected temporary maximum load T, the controller 66 generates a capacity mode signal to the target laundry washing machine 10*a* which, upon receipt, sets its temporary maximum load to T. The controller 66 may also set a resource threshold R associated with the temporary maximum load T. The resource threshold may, in the third operation scenario, be represented by a minimum amount of detergent to be provided via the detergent tray 24 (FIG. 2), in order to allow the laundry washing machine to start. The resource threshold may further be set based on e.g. a selected laundry processing program, as well as on a time of the day, a day of the week or a day of the month which may correspond to e.g. days when laundry is usually more heavily soiled.

Again referring to FIG. 3, the user inserts laundry to be washed into the washing chamber 28, whereupon the load sensing arrangement 46 detects the amount of laundry 48 in the drum 30. After closing the washing chamber door 56, if the load detected by the load sensing arrangement 46 is less than or equal to the temporary maximum load T, and if the detergent detector 23 (FIG. 2) signals to the controller 18 that the amount of detergent provided has reached the resource threshold R, the laundry washing machine controller 18 allows the user to start the laundry washing machine 10; else, it does not.

Figure 7:
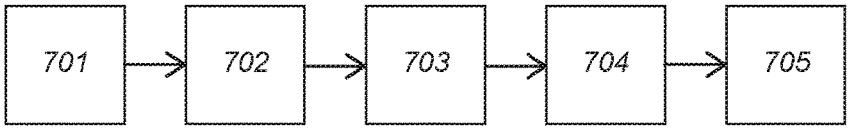
FIG. 7 is a flow chart illustrating second and third operation scenarios, the second and third operation scenarios illustrating an exemplary operation of the laundry facility of FIG. 5.

The second and third scenarios are schematically illustrated in the flow chart of FIG. 7:

In step 701, the user provides an amount of resources for operating the laundry washing machine.

In step 702, the controller 18 (FIG. 2) receives a capacity mode signal indicating a temporary maximum load T.

In step 703, the laundry washing machine 10 receives laundry 48 into the drum 30.

In step 704, the load sensing arrangement 46 weighs the laundry in the drum.

In step 705 the controllers 18, 66 decides, based on the weight of the laundry 48 in the drum 30 corresponding to a detected load equal to or less than the temporary maximum load T, and based on the amount of resources provided reaching a resource threshold R associated with said temporary maximum load T, whether to allow a laundry washing program to start. It is pointed out that steps 701 and 702 can be performed in any order at any point prior to step 705.

A fourth operation scenario will now be described with reference to a stand-alone laundry washing machine 10, i.e. a laundry washing machine which does not form part of a laundry facility 64 comprising multiple laundry washing machines. With reference to FIG. 2, the user may again wish not to use the detergent available from the internal detergent storage container 25, but instead, provide his/her own detergent via the detergent tray 24. The user inserts laundry to be washed into the washing chamber 28, whereupon the load sensing arrangement 46 detects the amount of laundry 48 in the drum 30. After closing the washing chamber door 56, the load sensing arrangement 46 makes a final detection of the load for the purpose of calculating a resource threshold defining an amount of detergent required for the detected laundry load. If the washing chamber door 56 is opened again prior to starting the laundry program, the laundry load is again determined by the load sensing arrangement 46 after closing the washing chamber door 56, to ascertain whether laundry has been added or removed. Once a final determination of the laundry load in the drum 30 has been made prior to starting the laundry washing program, the controller 18 determines a resource threshold R for the amount of detergent to be inserted into the detergent tray 24.

Upon insertion of detergent into the detergent tray 24, the detergent detector 23 generates a resource signal to the controller 18, indicating the amount of detergent inserted. Based on the resource signal indicating that an amount of detergent reaching the resource threshold R has been inserted, the controller 18 enables the user to start the laundry washing machine.

Figure 8:
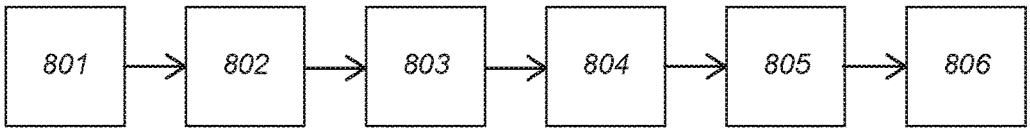
FIG. 8 is a flow chart illustrating a fourth operation scenario, the fourth operation scenario illustrating an exemplary operation of the laundry washing machine of FIGS. 1-3.

The fourth scenario is schematically illustrated in the flow chart of FIG. 8:

In step 801, the laundry washing machine 10 receives laundry 48 into the drum 30.

In step 802, the load sensing arrangement 46 weighs the laundry in the drum 30.

In step 803, the controller 18 determines a resource threshold R based on the weight of the laundry 48 in the drum 30.

In step 804, the user provides resources for operating the laundry washing machine.

In step 805, the controller 18 compares the resource threshold R with the amount of received resources.

In step 806, the controller determines, based on said comparison, whether the laundry washing machine is to be allowed to start.

It is pointed out that step 804 can be performed at any point prior to step 805.

Figure 9:
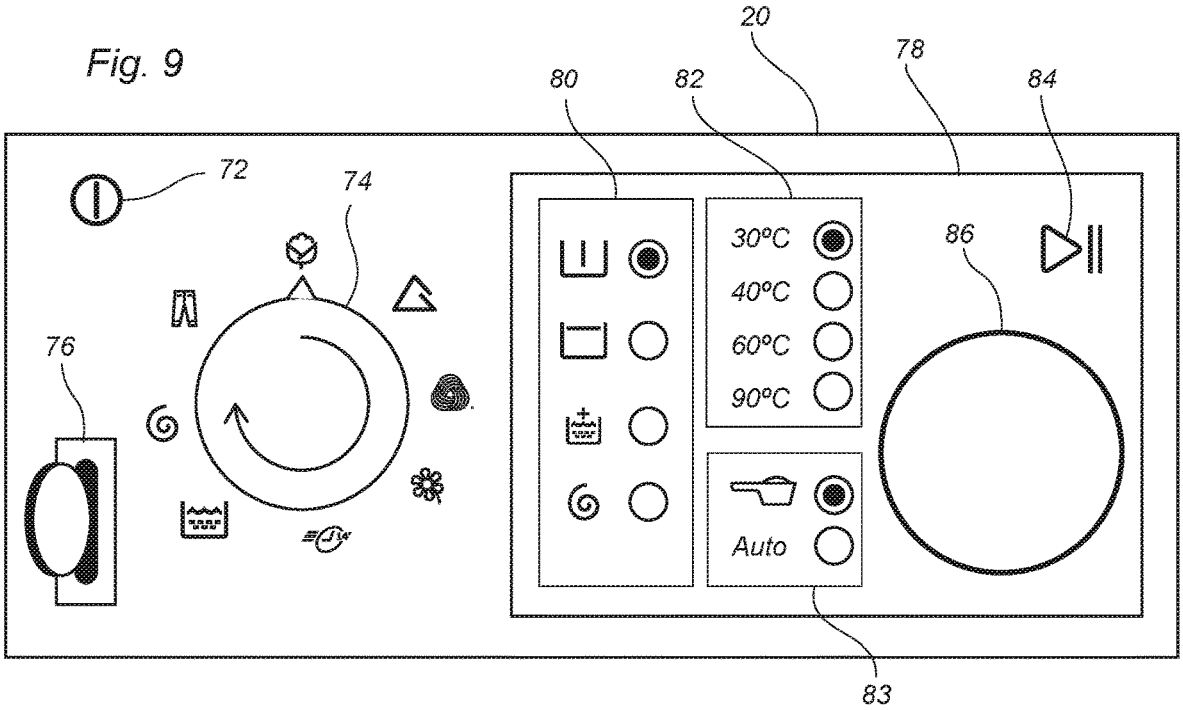
FIG. 9 is a schematic front view of a user interface of the laundry washing machine of FIGS. 1-3.

FIG. 9 illustrates an exemplary user interface 20 of the laundry washing machine 10 of FIG. 2. The exemplary user interface 20 comprises on/off button 72; a program selector 74 for selecting a desired laundry program, such as a cotton washing program, a synthetic fabric program, a wool program, a speed wash program, a rinse program, etc; a coin slot 76; and a touch screen 78. As illustrated, the program selector 74 may be configured as a dial knob. The touch screen 78 presents an options panel 80 allowing the user to select any washing program options, such as pre-wash, an extra rinsing step, reduced centrifuging, etc. The touch screen also presents a washing temperature selection panel 82, a panel 83 for selecting manual or automatic dispensing of detergent, a start button 84, and a resource indicator 86.

Figure 10:
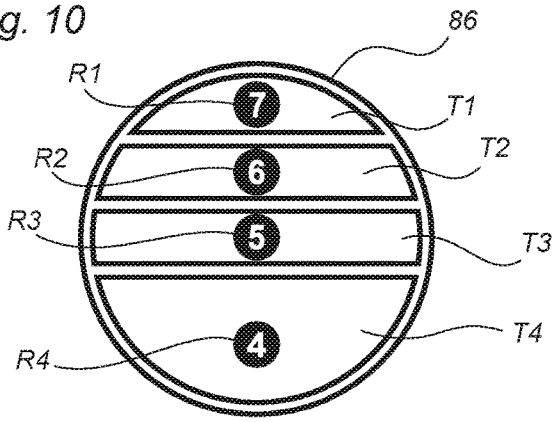
FIG. 10 is a schematic illustration of a resource indicator of the user interface of FIG. 9.

The resource indicator 86 will now be described in a fifth operation scenario, with reference to FIGS. 10, 11 and 12Also the fifth operation scenario will be described with reference to a stand-alone laundry washing machine 10 (FIG. 2).

The user may select a laundry washing program 74, along with any options 80, 83, and a desired temperature 82. Thereafter, controller 18 (FIG. 2) calculates, based on the selected laundry washing program, a resource threshold associated with each of a plurality of different temporary maximum loads. Each temporary maximum load T1, T2, T3, T4 represents a respective maximum amount of laundry, wherein T1>T2>T3>T4, and wherein T1 may correspond to the laundry washing machine's physical maximum load limit L1. The respective resource thresholds R1, R2, R3, R4, along with their associated temporary maximum loads T1, T2, T3, T4, may be presented to the user in the resource indicator, for example in the manner illustrated in FIG. 10. The resource thresholds R1-R4 may represent, for example, a monetary cost associated with each respective temporary maximum load T1-T4, or an amount of detergent required to be inserted into the detergent tray 24 for each respective temporary maximum load T1-T4. For example, the load T4 may be associated with a cost R4 of $4, the load T3 may be associated with a cost R3 of $5, the load T2 may be associated with a cost R2 of $6, and the load T1 may be associated with a R1 cost of $7. In the following it will be assumed, for simplicity, that the resource threshold corresponds to a required payment, even though the same scenario is applicable to a required amount of detergent. As is apparent from FIG. 10, the variable resource threshold R1-R4 comprises a fixed portion R4, which constitutes a minimum amount of resources required for starting a laundry washing program regardless of the amount of laundry, plus a variable portion which increases with the temporary maximum load.

After having been presented with the resource thresholds R1-R4, the user provides an amount of resources for operating the laundry washing machine. The amount of resources provided may, for example, be selected to correspond to any of the resource thresholds R1, R2, R3, R4. FIG. 11 illustrates an exemplary behaviour of the resource indicator 86 while the user inserts coins into the slot 76; in particular, the resource indicator 86 may illustrate the temporary maximum load T1-T4 corresponding to the amount of resources having been received. In the view of FIG. 11, the temporary maximum load is displayed as a vertical progress bar comprising segments representing respective temporary maximum loads T4, T3, T2, T1. In FIG. 11(*a*), the resource indicator 86 indicates having received resources corresponding to the resource threshold R4, by indicating a temporary maximum load T4; in FIG. 11(*b*), the resource indicator 86 indicates having received resources corresponding to the resource threshold R3, by indicating a temporary maximum load T3; in FIG.

Figure 11:
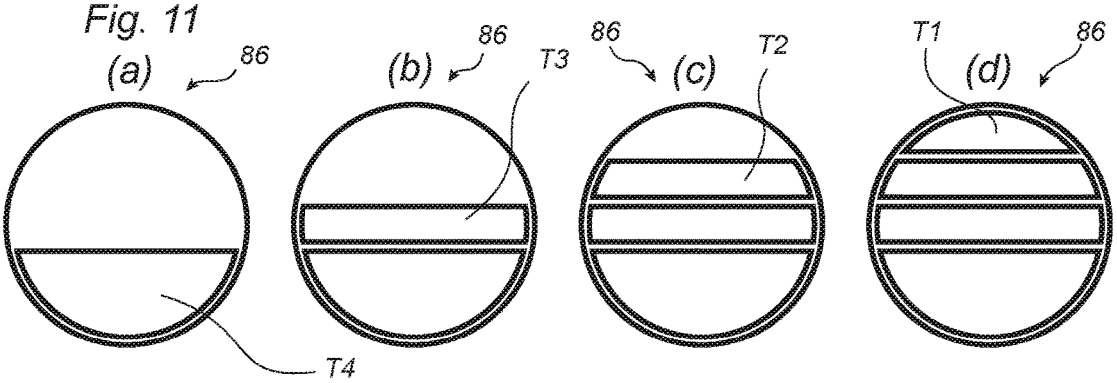
FIGS. 11(*a*)-(*d*) are schematic illustrations of the resource indicator of FIG. 10, wherein the resource indicator in each figure illustrates a different respective temporary maximum load of the laundry washing machine of FIGS. 1-3.

11(*c*), the resource indicator 86 indicates having received resources corresponding to the resource threshold R2, by indicating a temporary maximum load T2; and in FIG. 11(*d*), the resource indicator 86 indicates having received resources corresponding to the resource threshold R1, by indicating a temporary maximum load T1. Each time a new resource threshold R4, R3, R2, R1 is reached, the controller 18 generates a capacity mode signal changing the laundry washing machine's temporary maximum load to the respective load T4, T3, T2, T1 associated with the reached threshold.

Now with reference to FIG. 12, it is assumed that the user has provided an amount of resources R2 ($6), corresponding to a temporary maximum load T2 illustrated in FIG. 11(*c*). Once the user starts loading laundry into the drum 30 (FIG. 2), the resource indicator 86 will provide, based on a load signal from the load sensing arrangement 46, a load indication 88 indicating the amount of laundry in the drum 30. In FIG. 12, the load indication 88 is embodied as a vertical progress bar comprising segments corresponding to the loads T4, T3, T2, T1. In FIG. 12(*a*), the resource indicator 86 indicates a detected load 88 equal to or less than T4; in FIG. 12(*b*), the resource indicator 86 indicates a detected load 88 higher than T4 and equal to or less than T3; in FIG. 12(*c*), the resource indicator 86 indicates a detected load 88 higher than T3 and equal to or less than T2; and in FIG. 12(*d*), the resource indicator 86 indicates a detected load 88 greater than the temporary maximum load T2. This is indicated to the user by graphically illustrating the excess load in a pattern or colour different from a load within the maximum temporary load T2. If the load detected by the load sensing arrangement 46 (FIG. 3) exceeds the maximum temporary load, the laundry washing machine will not be allowed to start. Hence, in the situation illustrated in FIG. 12*d*, the user will have to remove laundry from the drum 30 and/or add more resources in order to enable the laundry washing machine 10 to start. FIG. 12(*e*) illustrates the situation when the user has added more resources, reaching up to the resource threshold R1 corresponding to temporary maximum load T1. Thereby, after closing the washing chamber door 56, the laundry washing machine 10 may be started by pressing the start button 72 (FIG. 9).

The fifth operation scenario above describes how resources are first provided, the resource indicator 86 displaying a temporary maximum load associated with the amount of resources provided. Thereafter, laundry is inserted, and the detected laundry load is displayed in the resource indicator 86 alongside with an indication of the temporary maximum load. The procedure may also take place in an opposite order: First, laundry may be inserted into the drum, the resource indicator 86 displaying, while the laundry is inserted, a gradually increasing resource threshold required for starting the laundry washing program, the displayed resource threshold being based on the amount of laundry 48 detected by the load sensing arrangement 46. After finishing loading laundry into the drum, resources may be provided by the user while the resource indicator 86 displays, alongside with the indication of the resource threshold, an illustration of the amount of resources received.

Clearly, instead of using a coin slot 76 (FIG. 9), the laundry washing machine may be configured to receive other means of payment, such as tokens, credit card payments, near-field communication payments using a mobile phone, etc. Tokens may be provided by, for example, inserting a number of physical tokens into a token slot arranged on the laundry washing machine or on a control panel operably connected to the laundry washing machine, or by withdrawing a number of virtual tokens from a user account associated with a user identity. The user identity may be verified using e.g. a smart card. However, as pointed out hereinabove, the methods may invoke also other types of resources and resource thresholds, such as for correctly dosing an amount of detergent.

Again referring back to FIG. 3, in some instances, there may be a need for preventing tampering with the load sensing arrangement 46. By way of example, looking at the drawing of FIG. 3, the detected load could be reduced 1) by wedging an object in the gap 90 between the drum assembly 26 and the front housing wall 22, 2) by applying a lifting force at an upper interior wall 92 of the drum 30, or 3) by applying a lifting force at an outer face of the washing chamber door 56.

All of those tampering cases may be detected, and if any tampering is detected, the laundry washing program may be prevented from starting. As has already been discussed hereinabove, by making a final determination of the load after the washing chamber door 56 has been closed for the last time prior to starting the washing program, tampering case 2) may be avoided.

Tampering cases 1) and 3) may be detected in several different ways. By way of example, the drum assembly load sensors 50 are spatially separated, such that the relationship between the load signal components from the respective load sensors 50 may indicate whether, with reference to the axis A (FIG. 3), one of the axial ends of the drum 30 or the drum assembly 26 has been lifted or wedged.

Another way of detecting tampering cases 1) and 3) may be to first detect a static load prior to rotating the drum 30; thereafter, rotating the drum 30 and detecting a dynamic load; and comparing the detected static load with the detected dynamic load. The relationship between the static and dynamic load may serve as an indicator of whether the drum assembly 26 has been tampered with.

Still another way of detecting tampering cases 1), 2) or 2) may be by comparing a load detection performed before closing any of the drum access doors 56, 60, with a load detection performed after closing said any of the drum access doors 56, 60. If the detected amount of laundry differs by more than a threshold amount, it may be assumed that the user has somehow lifted the drum 30 or drum assembly 26 while the respective drum access door 56, 60 was open.

Moreover, as the drum load sensor 54 detects the weight of the drum and laundry only, without responding to the weight of e.g. the washing chamber 28 or cradle 34, the drum load sensor 54 is relatively immune to wedging the washing chamber 28 or lifting the washing chamber door 56.

As earlier discussed with reference to FIG. 3, the outer housing door 60 blocks access to the drum assembly 26 from outside the housing 12. By making a final determination of the amount of laundry 48 in the drum 30 after closing the outer housing door, at least tampering case 3) may be avoided.

According to an embodiment, the load sensing arrangement, for example the drum assembly load sensors 50, may be configured to determine a horizontal component of the load on the drum assembly 26 or the drum 30. The presence of any horizontal load on the drum assembly 26 or the drum 30, e.g. along the direction of the rotation axis A, may indicate that an object has been wedged between the drum assembly 26 and the front housing wall 22.

Figure 14:
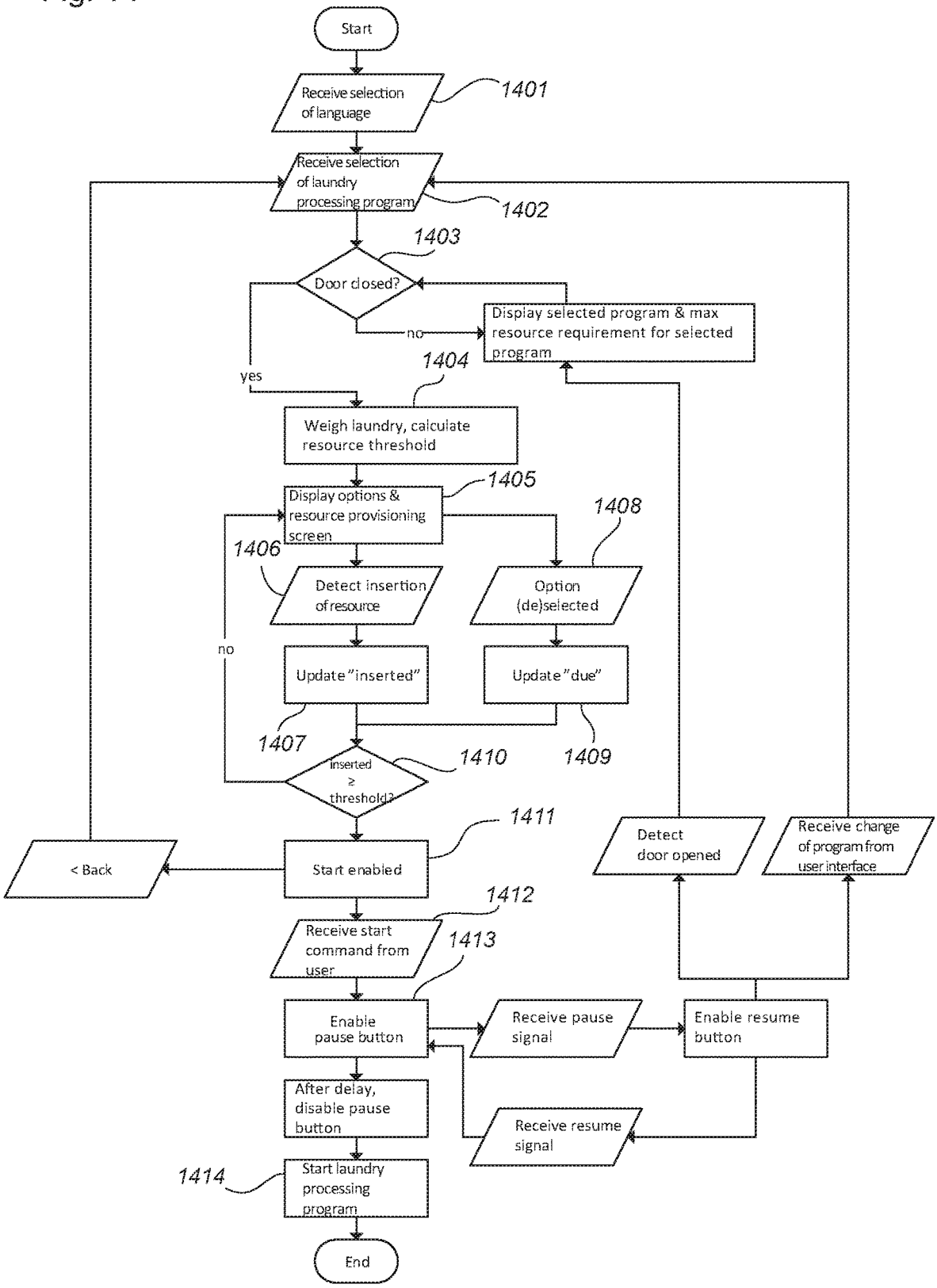
FIG. 14 is a flow chart illustrating a sixth operation scenario, the sixth operation scenario illustrating an exemplary operation of the laundry washing machine of FIGS. 1-3.

The flow chart of FIG. 14 illustrates a sixth operation scenario of the laundry processing machine 10 of FIGS. 1-4.

In step 1401, the user is allowed to select, via the user interface 20, a language for interacting with the laundry processing machine 10 via the user interface 20.

In step 1402, the user is prompted to select a laundry processing program.

In 1403, if the washing chamber door 56 is not closed, the user interface 20 displays the selected program along with a maximum resource requirement for the selected laundry processing program, wherein the maximum resource requirement is associated with a maximum load of the laundry processing machine 10. If the washing chamber door 56 is closed, the load sensing arrangement 46 weighs the laundry 48 in the drum 30 in step 1404, and calculates a resource threshold based on the detected weight.

In step 1405, the user is allowed to select any options 80, and is prompted to insert resources, such as chemical process aids, tokens, or coins. The amount of resources due for reaching the resource threshold is displayed.

In steps 1406 and 1407, the controller 20 detects insertion of resources, and updates a detected amount of resources having been inserted. Options may be selected or deselected in step 1408, thereby triggering, in step 1409, an update of the resource threshold as well as the remaining amount of resources due (i.e. the resource threshold minus the amount of resources having been inserted).

In step 1410, the controller 20 determines whether the amount of resources inserted exceeds the resource threshold. If yes, start is enabled in step 1411; otherwise, the controller 20 returns to step 1405.

In step 1412, the controller 20 receives a start command via the start button 82.

After receiving the start command, the controller enables, in step 1413, a pause or "regret" button allowing the user to, within a starting delay time, cancel the start and make changes. Changes can be made by opening the washing compartment door 56 for inserting or removing laundry 48, thereby returning to step 1403, or by changing the laundry processing program, thereby returning to step 1402. Alternatively, the user may resume the start by pressing a resume button, returning to step 1413.

After the starting delay, the controller 20 starts the laundry processing program in step 1414.

Hereinabove, a laundry washing machine 10 has been described with reference to e.g. FIGS. 1-4 and FIG. 9. For clarity and simplicity, only a single laundry washing machine 10, provided with many features and functions, has been described, and its operation has been discussed with reference to several different scenarios. However, it is pointed out that for each of those scenarios, only a subset of the features and functions of the laundry washing machine 10 are needed, while other features and functions are highly optional. The same reasoning applies to the laundry system 64 of FIG. 5, mutatis mutandis.

As has been suggested in the foregoing, the laundry washing machine 10 is only one example of the group of laundry processing machines which may benefit from the teachings herein. The teachings are also applicable, mutatis mutandis, at least to laundry dryers, combined washer dryers, and centrifuges. FIG. 13 illustrates a laundry facility 164 comprising laundry washing machines 10, laundry dryers 96, combined washer dryers 98, and centrifuges 99, each of which is configured to set a temporary maximum load, or to set a resource threshold based on a detected load, in accordance with the teachings hereinabove. The respective laundry processing programs may, for each respective alternative machine type 10, 96, 98, 99, be a laundry washing program, a laundry drying program, a combined laundry washing and drying program, and a centrifuging program, respectively.

The methods disclosed herein may be embodied in a computer program, which may be carried on a computer readable data carrier, illustrated in FIG. 15*t* in the embodiment of a Compact Disc 100.

The invention has mainly been described above with reference to a few embodiments. However, as is readily appreciated by a person skilled in the art, other embodiments than the ones disclosed above are equally possible within the scope of the invention, as defined by the appended patent claims.

In the claims, the word "comprising" does not exclude other elements or steps, and the indefinite article "a" or "an" does not exclude a plurality.

The invention claimed is:

1. A laundry processing machine, comprising:

a rotatable drum (30);

a load sensing arrangement (46) configured to detect an amount of laundry (48) in the drum (30) and, based on a detected amount of laundry (48), generate a load signal; and a controller (18, 66) configured to:

based on the load signal, set a resource threshold (R1, R2, R3, R4) for starting a laundry processing program, receive a resource signal indicating an amount of resources provided by a user of the laundry processing machine (10, 96, 98, 99), and based on the resource signal indicating that a sufficient amount of resources has been provided, allowing the laundry processing program to start, wherein the resource threshold (R1, R2, R3, R4) comprises a fixed portion (R4), which is independent of the load signal, plus a variable portion (R3, R2, R1), which is dependent on the load signal.

2. The laundry processing machine according to claim 1, wherein the controller (18, 66) is configured to display the resource threshold (R1, R2, R3, R4) via a user interface (20, 68).

3. The laundry processing machine according to claim 2, wherein the controller (18, 66) is configured to repeatedly, while the laundry processing machine (10, 96, 98, 99) is loaded via an open door (56):

receive a load signal;

update the resource threshold (R1, R2, R3, R4) based on the load signal; and display the updated resource threshold (R1, R2, R3, R4) on the user interface (20, 68).

4. The laundry processing machine according to claim 1, wherein said amount of resources provided by a user comprises an amount of chemical process aid provided to the laundry processing machine (10, 98) by the user, an amount of tokens or credits provided to a control system (18, 66) controlling the laundry processing machine (10, 96, 98, 99), or an amount of money provided to a payment system (70) operably connected to the laundry processing machine (10, 96, 98, 99).

5. The laundry processing machine according to claim 1, wherein the resource threshold is set based on any of a user identity, a user category, a selected laundry processing program, a time of the day, a day of the week, a day of the month.

6. The laundry processing machine according to claim 1, wherein the load sensing arrangement (46) comprises a plurality of spatially separated load sensors (50, 54), each load sensor (50, 54) configured to generate a respective load signal component, wherein the controller (18, 66) is further configured to allow the laundry processing program to start based on a relationship between the respective load signal components.

7. The laundry processing machine according to claim 6, wherein the controller is configured to determine the load signal components corresponding to a torque about a horizontal axis extending through the centre of the rotatable drum perpendicular to the drum axis (A) of rotation and, if the determined torque is below a predetermined level or a threshold determined based on the detected weight, start the laundry processing program.

8. The laundry processing machine according to claim 1, wherein the load sensing arrangement (46) is configured to detect a static load prior to rotating the drum (30), and the controller (18, 66) is configured to compare the static load with a dynamic load while rotating the drum (30), and based on the comparison, determine whether the drum (30) has been tampered with.

9. The laundry processing machine according to claim 1, wherein the controller (18, 66) is configured to determine whether to allow the laundry processing program to start based on a detection of the amount of laundry (48) in the drum (30) after closing of a drum access door (56, 60), such as an outer housing door (60) or a washing chamber door (56).

10. The laundry processing machine according to claim 1, further comprising:

a drum assembly suspension frame (36) provided with an outer laundry processing machine housing (12); and a drum assembly (26) comprising the drum (30) and a water-tight washing chamber (28) enclosing the drum (30), the drum assembly (26) being flexibly suspended in the drum assembly suspension frame (36);

wherein the outer laundry processing machine housing (12) further comprises an outer housing opening for receiving laundry into the drum (30), and an outer housing door (60) for blocking access to the drum assembly (26) via the outer housing opening;

wherein the load sensing arrangement (46) is arranged at an interface between the drum assembly (26) and the drum assembly suspension frame (36) to detect a load exerted by the drum assembly (26) on the drum assembly suspension frame (36); and wherein the controller (18, 66) is configured to allow starting the laundry processing program based on a load detected after closing of the outer housing door (60).

11. The laundry processing machine according to claim 1, further comprising:

a drum assembly (26) comprising the drum (30) and a water-tight washing chamber (28) enclosing the drum (30), the washing chamber (28) comprising a washing chamber door (56);

wherein the drum (30) is rotatably suspended in the washing chamber (28) via a drum suspension interface comprising a drum bearing (32);

wherein the load sensing arrangement (46) is arranged at the drum suspension interface for detecting a load exerted by the drum (30) on the washing chamber (28); and wherein the controller (18, 66) is configured to allow starting the laundry processing program based on a load detected after closing of the washing chamber door (56).

12. The laundry processing machine according to claim 1, further comprising: wherein the laundry processing machine (10, 96, 98, 99) is a laundry washing machine (10), a laundry dryer (96), a combined washer dryer (98), or a centrifuge (99).

13. The laundry processing machine according to claim 1, wherein the controller is further configured to:

receive a capacity mode signal indicating a temporary maximum load (T, T1, T2, T3, T4), the resource threshold (R1, R2, R3, R4) being associated with said temporary maximum load (T1, T2, T3, T4); and based on the load signal indicating a load equal to or lower than the temporary maximum load (T, T1, T2, T3, T4), allowing the laundry processing program to start.

* * * * *